US007571495B2

(12) United States Patent
Emeth

(10) Patent No.: US 7,571,495 B2
(45) Date of Patent: Aug. 11, 2009

(54) BILLBOARD GARMENT

(75) Inventor: Solomon Emeth, Los Angeles, CA (US)

(73) Assignee: The Billboard Clothing Company, LLC, Los Angeles, CA (US)

( * ) Notice: Subject to any disclaimer, the term of this patent is extended or adjusted under 35 U.S.C. 154(b) by 306 days.

(21) Appl. No.: 11/271,579

(22) Filed: Nov. 10, 2005

(65) Prior Publication Data

US 2006/0059600 A1 Mar. 23, 2006

Related U.S. Application Data

(63) Continuation-in-part of application No. 10/667,553, filed on Sep. 22, 2003, now abandoned.

(51) Int. Cl.
*A41D 27/08* (2006.01)
*A41B 1/00* (2006.01)

(52) U.S. Cl. ..... 2/244; 2/115

(58) Field of Classification Search ..... 2/244, 2/245, 246, 75, 80, 111, 92, 93, 101, 102, 2/108, 115, 119, 121, 122; 40/586
See application file for complete search history.

(56) References Cited

U.S. PATENT DOCUMENTS

| | | | | |
|---|---|---|---|---|
| 2,527,258 | A | 10/1950 | Kahn | |
| 2,647,261 | A | 8/1953 | Rassner | |
| 2,685,690 | A * | 8/1954 | Chrisman | 40/586 |
| 2,936,460 | A | 5/1960 | Jackson | |
| 3,828,368 | A | 8/1974 | Lam | |
| 4,086,516 | A | 4/1978 | Ogle | |
| 4,277,848 | A | 7/1981 | Boehland | |
| 4,446,573 | A | 5/1984 | Green | |
| 4,513,454 | A | 4/1985 | Anderson | |
| 4,709,307 | A | 11/1987 | Branom | |
| 4,710,981 | A | 12/1987 | Sanchez | |
| 4,834,688 | A | 5/1989 | Jones | |
| 4,924,613 | A | 5/1990 | Levin | |
| 4,969,214 | A | 11/1990 | Cohen | |
| 5,086,516 | A | 2/1992 | Baxter et al. | |
| 5,359,734 | A | 11/1994 | Rathburn | |
| 5,379,461 | A | 1/1995 | Wilmers | |
| 5,581,815 | A | 12/1996 | Hans | |
| 5,632,044 | A | 5/1997 | Sloot | |

(Continued)

FOREIGN PATENT DOCUMENTS

| | | | |
|---|---|---|---|
| JP | 2001-265259 | A | 9/2001 |

(Continued)

OTHER PUBLICATIONS

Gershman, Maurice, Self-Adhering Nylon Tapes, Journal of the American Medical Assn, Oct. 1958, p. 930, vol. 168, No. 7, United States.

*Primary Examiner*—Alissa L Hoey
(74) *Attorney, Agent, or Firm*—Greenberg Traurig, LLP

(57) ABSTRACT

A garment is disclosed having a detachable billboard panel on the front or back, or both, having indicia thereon for advertising a movie or sporting event or the like, an entertainment program, etc. The billboard panel is a removable panel that is quickly and easily mounted to or removed from the garment and flaps on the garment cover the securing elements.

8 Claims, 4 Drawing Sheets

U.S. PATENT DOCUMENTS

| | | | | |
|---|---|---|---|---|
| 5,794,267 | A | | 8/1998 | Wallace |
| 5,813,051 | A | | 9/1998 | Counter |
| D403,835 | S | * | 1/1999 | Geyer ..... D2/757 |
| 5,943,698 | A | * | 8/1999 | Blanks ..... 2/69 |
| 5,953,757 | A | | 9/1999 | Blanks et al. |
| 5,960,476 | A | | 10/1999 | Danzy |
| 6,032,287 | A | | 3/2000 | Kallas |
| 6,115,948 | A | | 9/2000 | Mitchell |
| 6,175,960 | B1 | | 1/2001 | Knittel |
| 6,199,210 | B1 | | 3/2001 | Feldman |
| 6,473,908 | B1 | | 11/2002 | Bontems |
| 6,526,587 | B1 | | 3/2003 | Jeziak et al. |
| 6,526,589 | B1 | | 3/2003 | Jeziak et al. |
| 6,698,903 | B2 | | 3/2004 | Hall |
| 6,782,554 | B1 | | 8/2004 | Froehlich |
| 2003/0188469 | A1 | | 10/2003 | Torres |
| 2004/0187184 | A1 | | 9/2004 | Rubin |

FOREIGN PATENT DOCUMENTS

| | | | |
|---|---|---|---|
| JP | 2003-049302 | A | 2/2003 |
| JP | 2003-177688 | A | 6/2003 |
| WO | WO 03/028496 | | 4/2003 |

* cited by examiner

FIG. 1
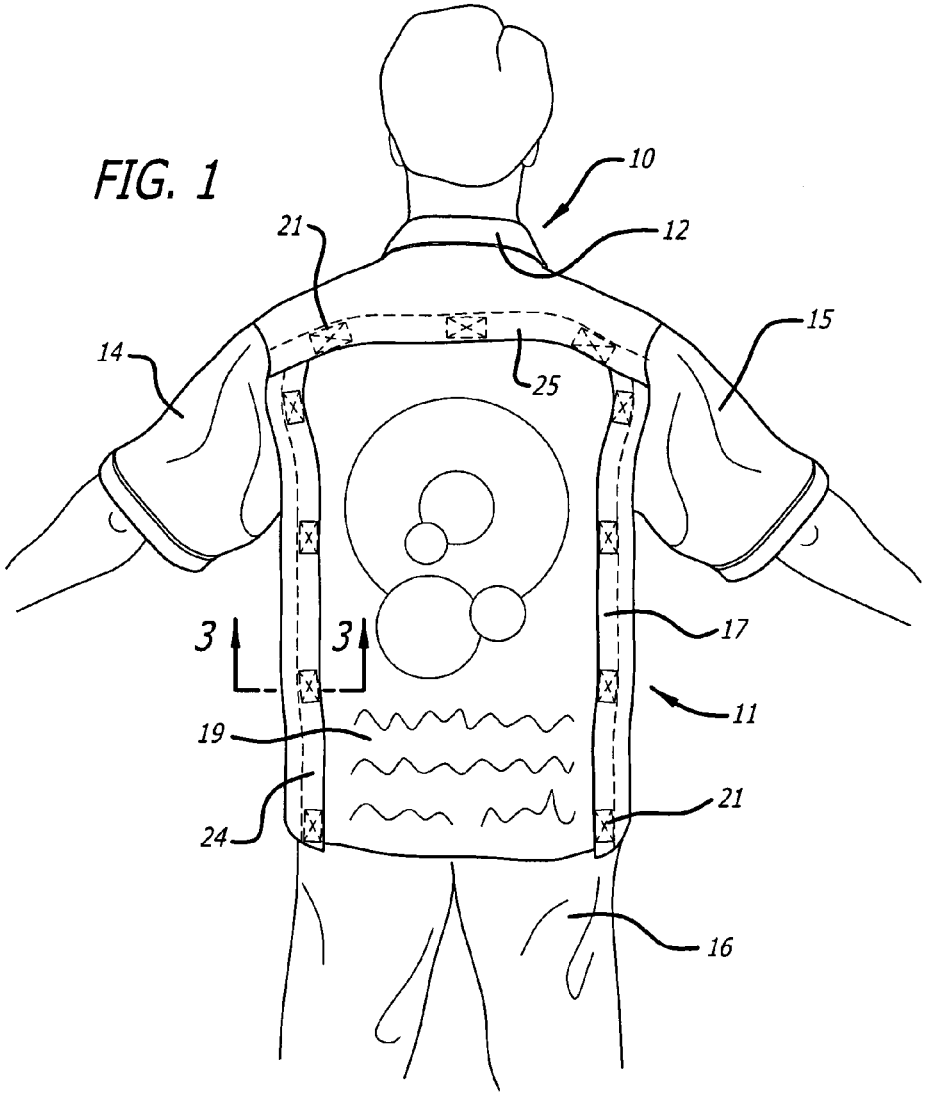
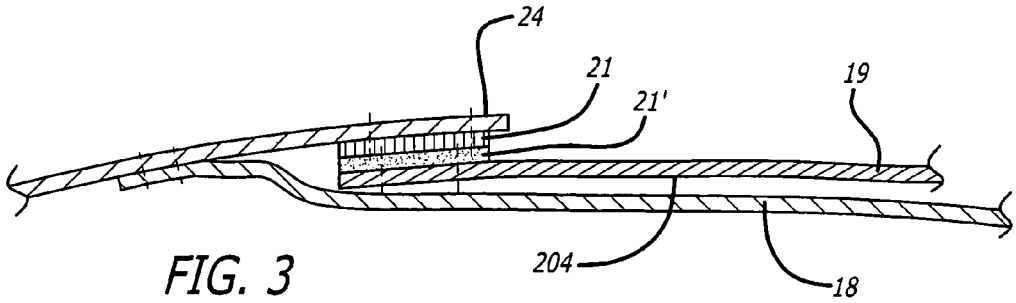
FIG. 3

BILLBOARD GARMENT

CROSS-REFERENCE TO RELATED APPLICATION

This application is a continuation-in-part of application Ser. No. 10/667,553, filed Sep. 22, 2003 now abandoned, the content of which is incorporated herein by reference in its entirety.

BACKGROUND OF THE INVENTION

1. Field of the Invention

The invention relates to garments, and, more particularly a garment having a removable billboard panel having indicia thereon.

2. Related Art

Various garments are known having pictorial representations thereon which can be changed to display a different representation. One such garment is disclosed in U.S. Pat. No. 4,086,516. However, the garment bearing the pictorial representation cannot be worn without it since it gives the appearance of a jacket that has something missing on the back thereof.

Another such garment is disclosed in U.S. Pat. No. 5,960, 476 to Danzy. However, this garment has a transparent panel on the back so one can display a tattoo through the panel. There is no removable billboard panel.

Some garments, such as that disclosed in U.S. Pat. No. 4,710,981 to Sanchez, have panels that can be opened or closed to display a message or other indicia. There is no completely removable panel.

U.S. Pat. No. 5,953,757 to Blanks shows a pouch on a garment in which images can be displayed. Without such image, the garment would appear unfinished or incomplete without the image thereon.

It can be seen that there is a need for a garment, complete in itself, which can be used to display a totally removable billboard panel having indicia thereon which can be changed to display differing indicia.

SUMMARY OF THE INVENTION

It is an object of this invention to provide a garment, such as a jacket, complete in itself, having a completely removable billboard panel having indicia thereon on the front or back thereof.

It is a further object of this invention to provide such a garment wherein the detaching means are not visible from the front or back of the garment.

It is still further an object of this invention to provide a garment wherein flaps may be secured to a preexisting garment and detaching means, such as pieces of a Velcro® material, are provided on a removable billboard panel, having indicia thereon, which may be quickly and easily applied to or removed from the front or back of the garment.

These and other objects are preferably accomplished by providing a garment having a detachable billboard panel on the front or back thereof having indicia thereon for advertising a music or sporting event, a movie, etc. The billboard panel is a removable panel that is quickly and easily mounted to or removed from the front or back of the garment and flaps on the front or back of the garment cover the means for releasably securing the removable panel to the front or back of the garment, or both.

BRIEF DESCRIPTION OF THE DRAWINGS

FIG. 1 is a rear perspective view of a person wearing a garment in accordance with the teachings of the invention showing the panel on the back thereof;

FIG. 3 is a view taken along lines 3-3 of FIG. 1;

DESCRIPTION OF THE PREFERRED EMBODIMENTS

Figure 2:
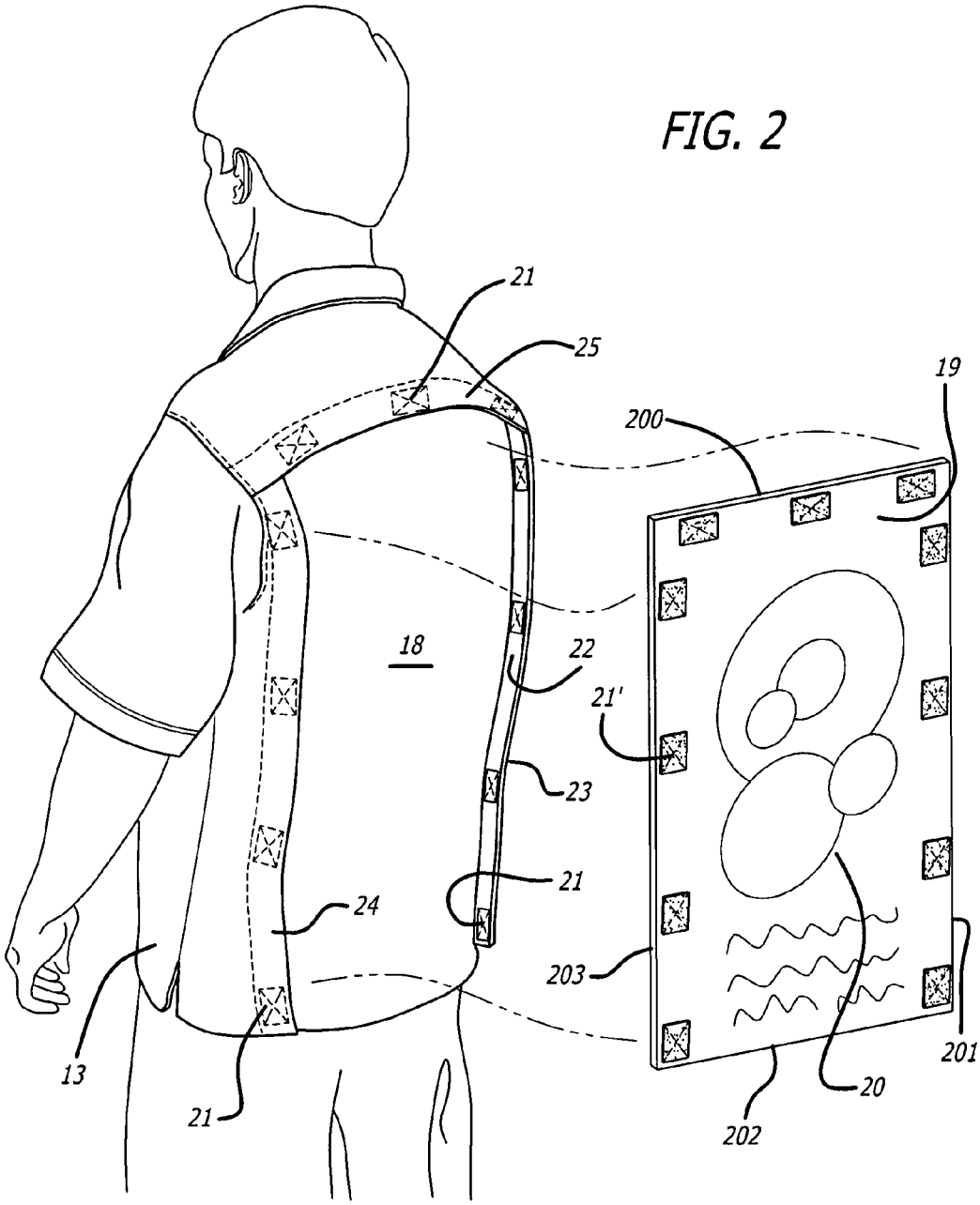
FIG. 2 is a side perspective view, similar to FIG. 1, illustrating how the billboard panel of FIG. 1 is removably attached to the garment.

Referring now to FIG. 1 of the drawing, a person 10 is shown wearing a garment 11 in accordance with the teachings of the invention. As will be discussed, garment 11 may be any suitable type of garment worn by a man, woman or child. Thus, the garment 11 illustrated, in the conventional sense, has a collar 12, an integral main body portion 13 (see also FIG. 2) and a pair of spaced apart integral sleeves 14, 15 (FIG. 1) on opposite sides of the upper portion of main body portion 13.

As shown in FIG. 1, sleeves 14, 15 may be short sleeves and the main body portion 13 may be worn outside of trousers 16.

Of course, the main body portion 13 may be worn inside of trousers 16 and sleeves 14, 15 may be long sleeves, if desired.

In any event, the size of garment 11 is not critical to the teachings of the invention and may be of any suitable size for a man, woman or child. It may also be of any suitable style.

As particularly contemplated in the present invention, the garment 11 has a border 17 along the top and two spaced sides on the rear of garment 11. This border 17 extends about the periphery of an integral back panel 18 (FIG. 2) of garment 11. A removable billboard panel 19 is adapted to be removably secured within border 17 of garment 11 and against back panel 18. This removable billboard panel 19 has indicia 20 thereon which can be of any suitable type. For example, one could advertise a particular recording group, a store, restaurant, a sporting event, etc. One could advertise an upcoming movie or attraction in an amusement park or the like.

One desirable use of the billboard panel 19 of the invention is that, since it is removable, the subject matter of indicia 20 can be quickly and easily changed. For example, employees of an amusement park can wear garment 11 with panel 19 advertising a new park attraction or a recent movie related to the park.

Panel 19 can then be quickly and easily removed and a new panel, with a different movie or park attraction or the like, can be substituted. Also as seen in FIG. 2, panel 19 is defined by four interconnected borders 200 through 203.

Any suitable means may be used to enable panel 19 to be quickly and easily removed.

For example, as seen in FIGS. 1 and 2, a plurality of patches of one mating portion of a conventional hook and loop material, such as Velcro®, a registered trademark of Velcro Industries BV Limited Liability Company, may be used either sewn or otherwise secured in place as shown. Thus, as seen in dotted lines in FIGS. 1 and 2, four such patches 21 are provided on the underside 22 (FIG. 2) of one side flap 23 with four such patches 21 also provided on the underside of the other side flap 24. Three such patches 21 may be provided on the underside of top flap 25.

Removable billboard panel 19 has a like number of patches 21' (FIG. 2) at spaced locations along the top and sides of the border thereof corresponding to the location of patches 21. As seen, patches 21' normally face outwardly of garment 11. Of course, patches 21 may be of one mating piece of Velcro® material, such as the hook portion, and patches 21' may be of the other mating portion, such as the loop portion.

As can be seen by comparing FIG. 1 with FIG. 2, it can be appreciated that panel 19 can be placed against integral back panel 18 of garment 11 and removably secured in place by engagement of patches 21 and 21' as seen in FIG. 3. These patches 21, 21' are not visible to the viewer as seen in FIG. 1 since flaps 23 to 25 cover the same. When it is desired to remove panel 19, the patches are disengaged and the panel 19 is removed as seen in FIG. 2. The panel 19 is thus secured to the back panel 18 solely by the quick release fasteners. The back surface 204 (FIG. 3) of panel 19 abuts against back panel 18. The billboard panel 19 substantially covers garment back panel 18 as can be seen by comparing FIGS. 1 and 2.

It can be appreciated that, although a conventional hook and loop material, such as Velcro®, has been discussed, other quick release means such as zippers, snaps, etc. may be used. Velcro® is preferred since it is readily available, waterproof, adheres together firmly, then is easily released, etc. It will not rust as metallic elements would.

It can also be seen that a conventional garment, such as a jacket, can be modified to add flaps 23 to 25 thereto, such as by stitching. Also, the garment of the invention, as shown in FIG. 2 with panel 19 removed, functions as a conventional jacket since no visible securing means is displayed. That is, the patches 21 are covered by flaps 23 to 25.

Figure 4:
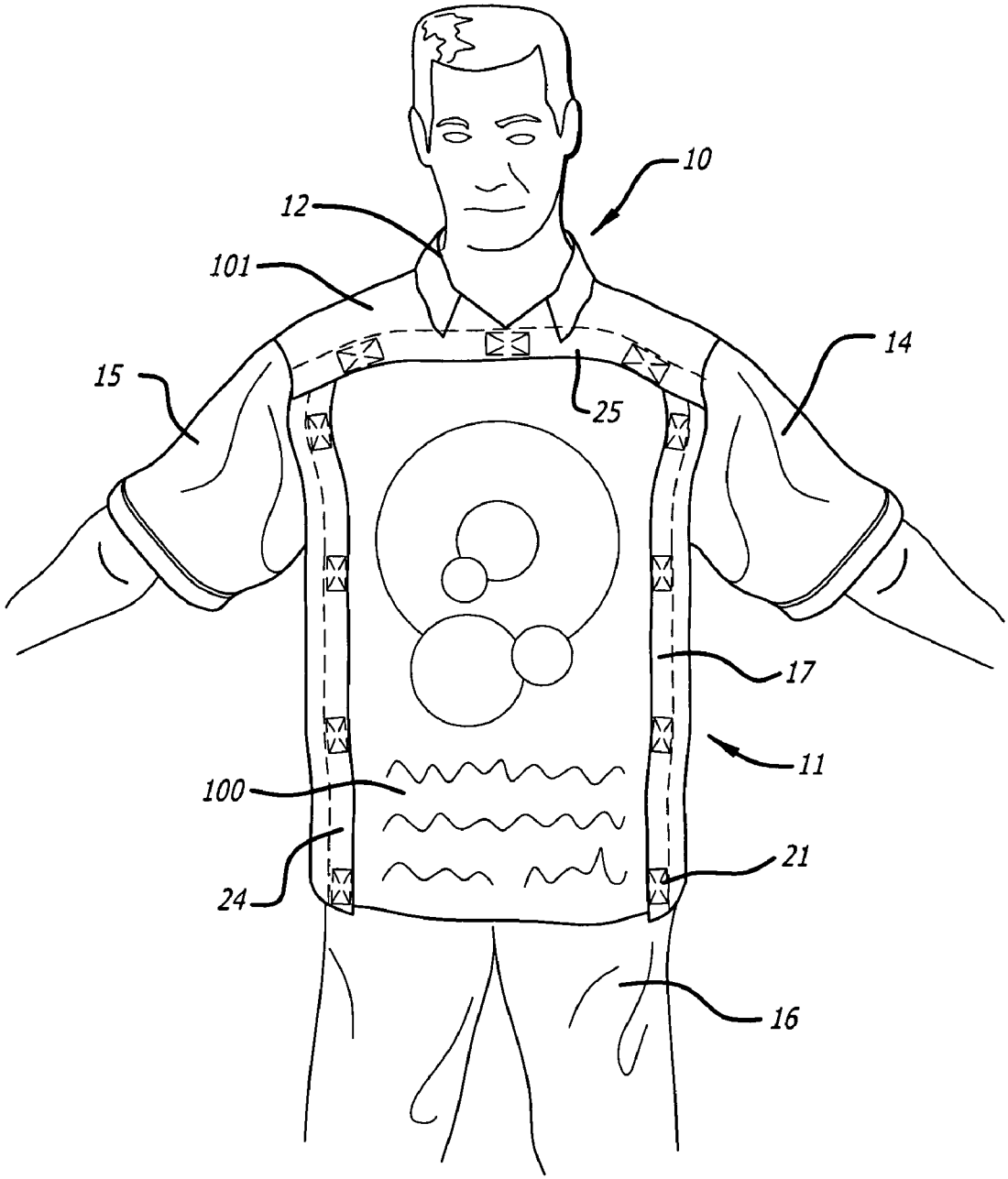
FIG. 4 is a view similar to FIG. 1 showing the panel of FIG. 1 on the front of a garment.

Although the back of a garment is shown in FIG. 1, the garment 10 of FIG. 1 may have a panel 100, identical to panel 19, on the front side 101 of garment 10 as seen in FIG. 4. Like numerals thus refer to like parts of FIG. 1. It is to be understood that panel 100 is secured in place in like manner as the panel 19 in FIG. 1. Obviously, garment 10 may be provided with a panel, similar to panels 19, 100, on either or both sides of garment 10. Garment 10 may have a conventional back with a panel, such as panels 19, 100, in front, or a conventional front, with a panel, such as panels 19, 100, in back.

Figure 5:
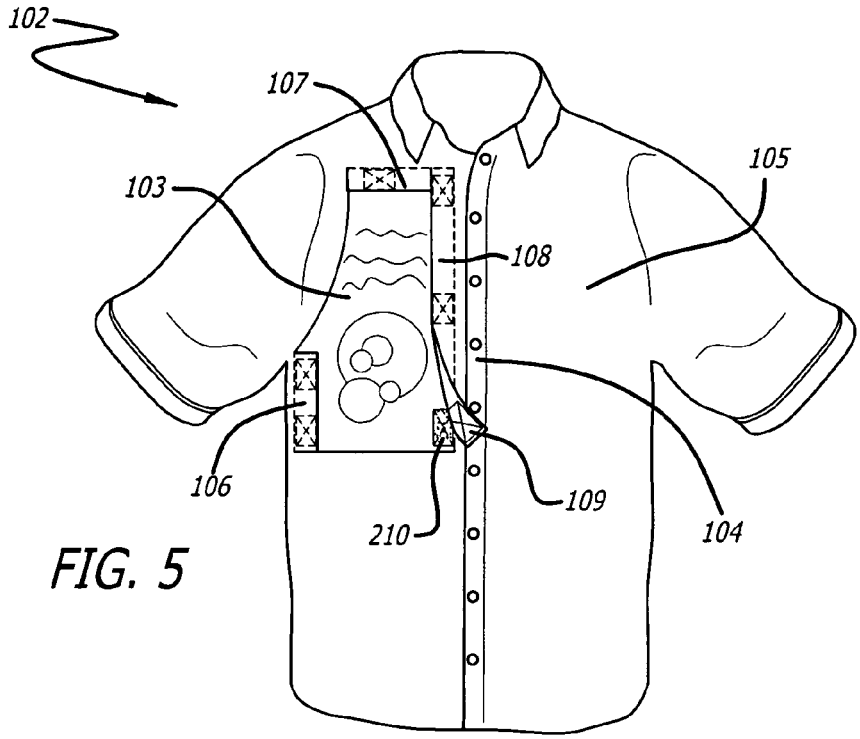
FIG. 5 is a view of the front of the garment of FIG. 1 showing a removable panel, similar to the panel shown in FIG. 1, on the front of the garment of FIG. 1.
Figure 7:
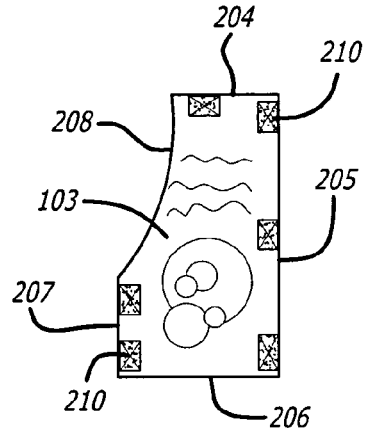
FIG. 7 is an elevational view of the removable panel alone of FIG. 5.

A different garment 102 is shown in FIG. 5. An irregularly shaped panel 103, similar to panels 19, 100, but differently configured, is shown on one side of the front of garment 102, buttons or a zippered area 104 separating panel 103 from the other side 105 of the front of garment 102. Flaps 106 to 108 are provided, similar to the flaps of FIG. 1, having Velcro® patches 109, similar to patches 21 of FIG. 1, on the underside of flaps 106 to 108. Panel 103 has mating Velcro® patches 210, similar to patches 21, on the outside of panel 103 as seen in FIG. 7.

Figure 6:
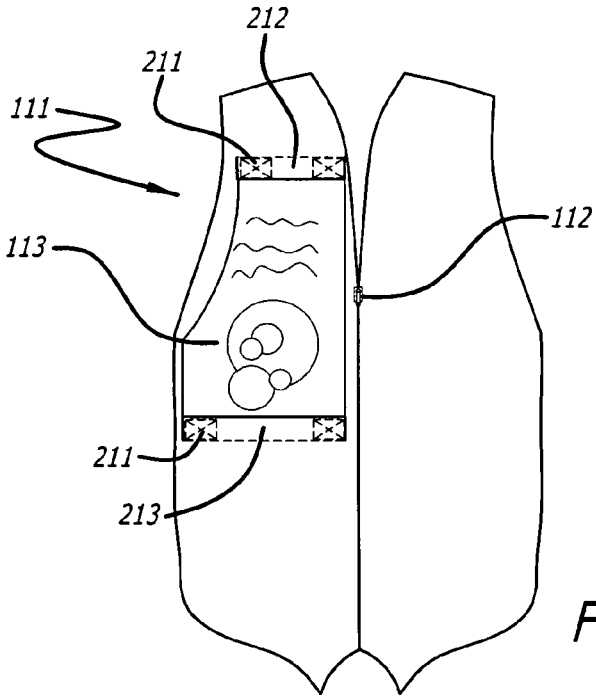
FIG. 6 is a view similar to FIG. 5, showing the removable panel of FIG. 5 as a vest.

FIG. 6 is a view similar to FIG. 5 showing a vest 111 having cut-out armpit areas with a centrally located zipper 112 on the front of vest 111. A panel 113, similar to panel 103 of FIG. 5, is provided on one side of the front of the garment. Panel 113 is removably held in position similar to panel 103 in FIG. 5 using mating pieces of Velcro® material (patches 211 are on the inside of flaps 212, 213 and mate with like patches, not shown, similar to patches 210 on the outside of panel 113).

Panels 113 and 103 are also defined by their outer interconnected borders such as borders 204 to 208 in FIG. 5 (panel 103 having similar outer borders), and also secured to its respective garment solely by the quick release fasteners.

Although a particular embodiment of the invention is disclosed, variations thereof may occur to an artisan and the scope of the invention should only be limited to the scope of the appended claims.

What is claimed is:

1. A garment adapted to be worn by an individual and adapted to cover the individual's upper torso, the garment comprising:

a main body portion having a front surface and a rear surface with a panel on one side thereof having an upper end, and spaced sides interconnecting said upper end;

a plurality of flaps integral with said garment and forming a border about the upper end and interconnected sides only of said main body portion panel, each of said flaps having a flat appearance and a first side engaged with said garment and a second smooth unadorned free side spaced from said first side;

said flaps having an outer facing surface and an inner facing surface overlying said main body portion panel;

a plurality of quick release fasteners disposed on said inner surface of said flaps and spaced from said free side and thereby hidden from view by said outer facing surface of said flaps;

a removable billboard panel comprised of a flat planar element defined solely by four interconnected borders covering at least a portion of said main body portion panel, said billboard panel having a back surface overlying said main body portion panel and a front surface having indicia thereon; and said flaps overlying a portion of said billboard panel and said billboard panel front surface further including a plurality of quick release fasteners for cooperating with and engaging said quick release fasteners on said inner surface of said flaps, said billboard panel being secured to said panel of said main body portion solely by said engaged quick release fasteners and having an outwardly visible front surface with said indicia thereon defined by either said borders or said flaps, the other side of said main body portion being devoid of any visible means supporting said billboard panel on the one side of said main body portion.

2. The garment of claim 1 wherein said flaps comprise a first flap extending along the upper portion of the back of said garment and a pair of spaced second and third flaps extending on opposite sides of the back of said garment.

3. The garment of claim 2 wherein said quick release fasteners include a plurality of sets of mating elements, each set including a first mating element adapted to be releasably secured to a second mating element.

4. The garment of claim 3 wherein said first mating elements are provided on the underside of said flaps.

5. The garment of claim 3 wherein said second mating elements are provided on the side of said billboard panel away from the back of said garment.

6. The garment of claim 3 wherein said flaps normally cover said first and second mating elements when said billboard panel is removably secured to said garment.

7. The garment of claim 1 wherein said mating elements comprise patches of mating hook and loop material.

8. A garment adapted to be worn by an individual and adapted to cover the individual's upper torso, the garment comprising:

a main body portion having a front side and a back side with an integral back panel on said back side, said panel having an upper end, and spaced sides interconnecting said upper end;

a plurality of flaps integral with said garment and forming a border about the upper end and interconnecting sides only of said back panel, each of said flaps having a flat appearance and a first side fixed to said garment and a second smooth unadorned free side spaced from said first side;

said flaps having an outer facing surface and an inner facing surface overlying said back panel;

a plurality of quick release fasteners disposed on said inner surface of said flaps and spaced from said free side and thereby hidden from view by said outer facing surface of said flaps;

a removable billboard panel substantially covering said back panel between said flaps, said billboard panel having a back surface abutting against said back panel and a front surface having indicia thereon; and said flaps overlying a portion of said billboard panel and said billboard panel front surface further including a plurality of quick release fasteners for cooperating with and engaging said quick release fasteners on said inner surface of said flaps, said removable panel being secured to said main body portion solely by said engaged quick release fasteners on said flaps and said removable panel and having an outwardly visible front surface with said indicia thereon defined by said second free sides of said flaps thereby forming a peripheral border partway around said removable billboard panel, said billboard panel being held against said back panel solely by said cooperating quick release fasteners on said flaps and said removable panel so that another removable panel can be substituted for the first mentioned removable panel, the front side of said main body portion being devoid of any visible means supporting said billboard panel.

* * * * *